US006793454B2

(12) United States Patent
Brizzi

(10) Patent No.: US 6,793,454 B2
(45) Date of Patent: Sep. 21, 2004

(54) DEVICE FOR TURNING PILES OF SHEET-LIKE MATERIAL

(75) Inventor: Nicolas Brizzi, Martigny (CH)

(73) Assignee: Bobst S.A. (CH)

( * ) Notice: Subject to any disclaimer, the term of this patent is extended or adjusted under 35 U.S.C. 154(b) by 0 days.

(21) Appl. No.: 10/406,678

(22) Filed: Apr. 3, 2003

(65) Prior Publication Data

US 2003/0188954 A1 Oct. 9, 2003

(30) Foreign Application Priority Data

Apr. 3, 2002 (CH) ..... 0561/02

(51) Int. Cl.[7] ..... B25J 11/00
(52) U.S. Cl. ..... 414/767; 414/766; 414/765
(58) Field of Search ..... 414/764, 765, 414/766, 767; 198/431

(56) References Cited

U.S. PATENT DOCUMENTS 2,865,516 A * 12/1958 Hedderich ..... 414/765
2,984,364 A * 5/1961 Lamb ..... 414/676
3,071,257 A * 1/1963 Jones et al. ..... 414/767
3,071,258 A * 1/1963 Seigh et al. ..... 414/766
3,547,279 A * 12/1970 Radomski ..... 414/765
3,580,402 A * 5/1971 Tolf et al. ..... 414/789.1
3,710,955 A * 1/1973 Redman et al. ..... 414/765
3,779,410 A * 12/1973 Phillips et al. ..... 414/418
4,354,788 A * 10/1982 Giusti ..... 414/791.3
4,798,278 A * 1/1989 Cornacchia ..... 198/399
5,971,695 A * 10/1999 Batzer et al. ..... 414/765

* cited by examiner

*Primary Examiner*—Joe Dillon, Jr.
(74) *Attorney, Agent, or Firm*—Ostrolenk, Faber, Gerb & Soffen, LLP

(57) ABSTRACT

An apparatus for conveying blanks or sheets that are arranged in piles includes a frame that has an input and an output and a pre-section that aligns the piles of blanks along a longitudinal conveying path. The pile of blanks is conveyed to a turn-over grip that swivels around the horizontal axis that extends transversely to the longitudinal conveying path. The turn-over grip includes two conveying units that are juxtaposed to one another with one of them being used to deliver the piles entering the turn-over grip and the other which is used to remove the piles after the turn-over grip has turned the pile upside down. A tightening mechanism presses one of the conveying units towards the other during the rotation of the turn-over grip. A pusher carriage is situated between the two conveying units and driven by a motor.

12 Claims, 6 Drawing Sheets

DEVICE FOR TURNING PILES OF SHEET-LIKE MATERIAL

BACKGROUND OF THE INVENTION

The present invention relates to a device for turning over piles of sheet-like material. A frame with an input and output aligns the piles according to a longitudinal conveying path of the piles. A turn-over grip, mounted to swivel around a horizontal axis extending transversely to the longitudinal direction, comprises two conveyors that are vertically juxtaposed to each other. These two conveyors sandwich the pile between them, and swivel to turn the pile upside down. One conveyor is used for delivering the piles into the device, and the other for unloading the piles after the turn-over operation has been completed. A pressing device exerts a pressure on the pile through the conveyors during the rotation. In other words, the device of the present invention receives piles of stacked sheets and selectively turns them upside down.

One-sided printed cardboard blanks are cut out with the printed side facing upwards. In the subsequent processing operations leading to a folder-gluer for processing blanks, the printed side must face downwards, which requires turning over of the blank piles. The task is extremely difficult, and more problematic when the blank's surface is wide. The difficulty owing to the need to turn over such piles is aggravated by the fact of having to carry and convey these piles, and have a laborer assigned to the task of turn over several tons of cardboard per day.

A device for turning over piles has already been made available in the prior art. But the available devices are inconvenient and raise various issues pertaining to precision, reliability, process monitoring, the need to mark the first blanks of each pile by two series of rollers between which the pile is strongly pinched during the turning operation, the ability to handle differently sized blanks, and other issues, all of which have been responsible for the prior art devices not becoming a commercial success.

Given the processing speed reached by current folder-gluers, it is imperative to avoid the need for manual operations, particularly ones related to the turning over of the piles, not only to reduce the pain and inconvenience of the job, but also to avoid unnecessary labor, increased production costs and reduced production rates.

SUMMARY OF THE INVENTION

It is an object of the present invention to reliably solve the problem of turning over piles of sheets or sheet-like material, by creating a buffer zone allowing loading freedom for the conductor.

Essentially, in a device according to the present invention, there is provided a frame including an input and an output, that is aligned according to a longitudinal conveying path of the piles. A fold-over or turn-over grip, which swivels around a horizontal axis extending transversely to the longitudinal direction, is constituted as two conveying units that are juxtaposed to one another, with a lower one of the conveying units being deployed for delivering the piles entering the device and the other, upper conveying unit serving for removing the piles after the overall unit has been turned upside down around the horizontal axis.

A pressing unit acts on the piles by resiliently biasing one of the conveying units during the rotation, so that the pile is tightly sandwiched between the two conveying units.

The device further includes telescopic thrusts and a pusher carriage that assist in moving the pile of material between the conveying units, in order to remove the pile from between the conveyor by moving forward, or alternatively, to move the pile backwards, if needed.

The device of the invention allows and enables entirely automatic feeding of the material in the folder-gluer machine. The sole manual operation remaining is the setting or loading of the piles of cardboard sheets on a belt conveyor located upstream. This enables continuous feeding from a pre-feeder arranged between the turning over device and the folder-gluer. Overall, the device and system of the present invention facilitate attaining much faster processing rates of the folder-gluer.

Other features and advantages of the present invention will become apparent from the following description of the invention which refers to the accompanying drawings.

DETAILED DESCRIPTION OF PREFERRED EMBODIMENTS OF THE INVENTION

Figure 1:
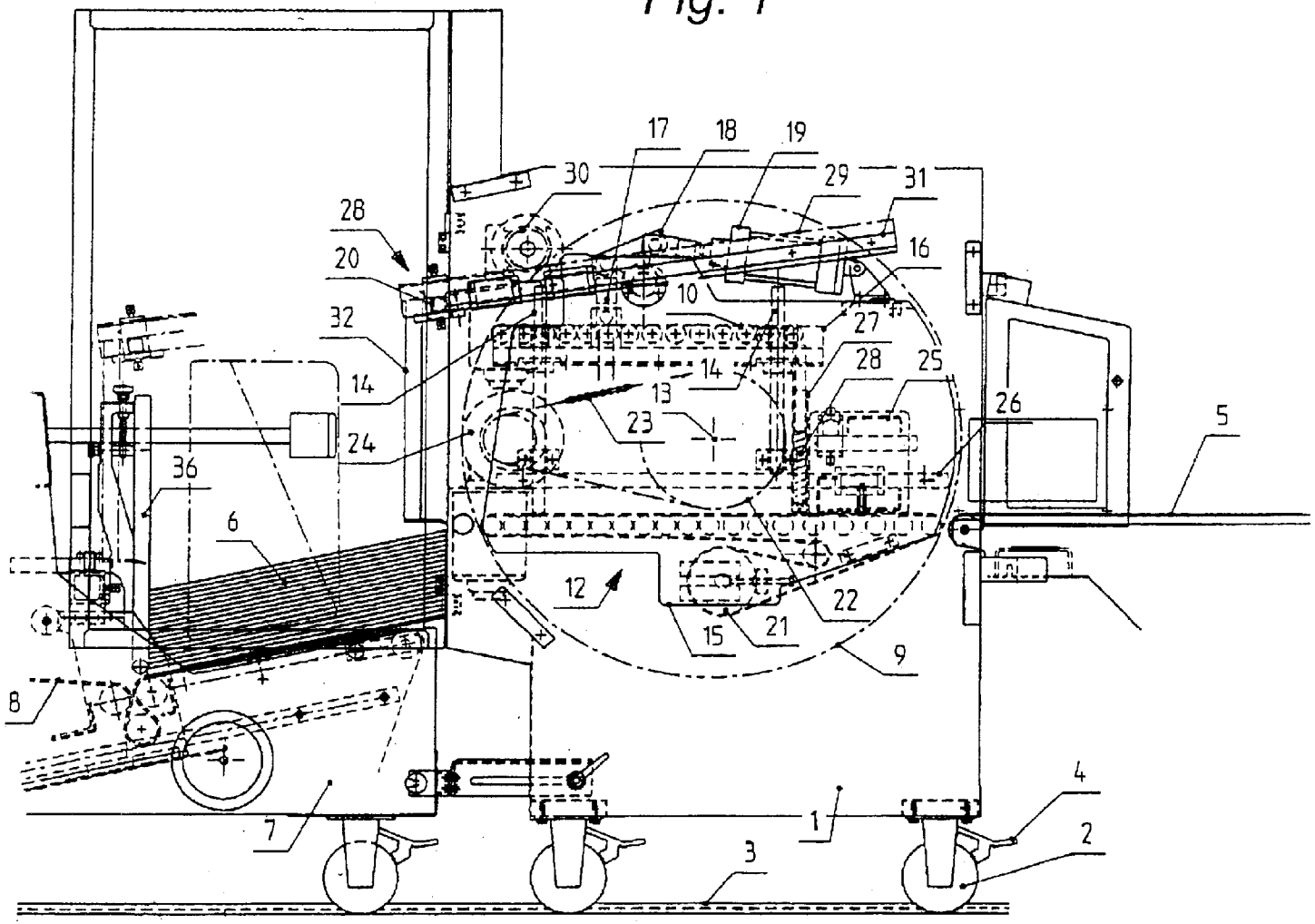
FIG. 1 is a lateral side view of the device of the present invention.

The device for turning piles of material upside down that is illustrated in FIG. 1 comprises a substantially parallelepiped-shaped frame 1 defined by two parallel side walls connected by two walls or spacers, and a lower and upper wall. The entire device is arranged on four wheels 2 connected to guiding rails 3 through break units 4. The front end of an endless belt conveyor 5 of a feeding unit penetrates this parallelepiped-shaped frame 1, through an aperture created in a transverse wall of the frame, arranged relative to the conveying direction of the piles of cardboard sheets 6, which is parallel to the view of FIG. 1.

The output of this frame 1 is located on the opposite transverse wall of the frame 1 and is coupled to a pre-feeder 7 with a slanted surface comprising a belt conveyor 8 located below the output level of the device for receiving the turned-over piles. A turn-over grip 12 is arranged between two parallel supporting plates 15, and the entire structure is assembled to swivel inside this frame 1. These parallel support plates 15 swivel about a horizontal pivoting axis 13 that extends transversely to the path of the sheet piles 6, along a circular run 9. These two parallel supporting plates 15 are connected to one another through transverse spacers so as to jointly swivel about the pivoting axis 13.

The turn-over grip 12 comprises a plurality of aligned rollers 10 that transversely extend between the two parallel supporting plates 15 and which carry the pile under a belt conveyor 11. See FIG. 3. The belt conveyor 11 is freely conveyed around the part of the spacers connecting the two parallel supporting plates 15. These rollers 10 are arranged to swivel on a fame 16 which is slidingly mounted by means of four guiding slides 14, respectively and interdependently between the parallel supporting plates 15. These guiding slides 14 are vertically arranged at the time that the turn-over gripper is in a position for delivering or unloading these piles.

A frame 16 is intercoupled with a transmission shaft 17 that is joined to a pivoting member 18 that is in turn connected to the rod of a jack 19 intended to move the frame 16 along the guiding slides 14. The series of rollers 10 are intended to deliver piles of sheets 6 at the time that they are being inputted into the turning device, and then to press them against the belt conveyor 11 that is coupled to the parallel supporting plates 15, for the purpose of pressing securely holding them during the process of being turned over.

The belt conveyor 11 is an intercoupled component of the turn-over grip 12 and is so arranged within the overall turn-over grip 12 that the distal ends of the conveyor 11 constitute points which lie on the notional circle 9 formed by the turning of the turn-over gripper around the axis 13. The belt conveyor 11 is driven by a motor 21 and the belt conveyor 11 is instrumental in moving a pusher carriage 25, arranged slidingly on two lateral guiding wheels 26 which are intercoupled to the related parallel supporting plates 15. The pusher carriage 25 to which is attached a telescopic thrust 27, extends between the belt conveyor 11 and the series of rollers 10. A pull-back spring 28 adapts the length of the telescopic thrust 27 to the spacing between the belt conveyor 11 and the series of rollers 10.

One of the supporting plates 15 is intercoupled with a crown gear 22 connected to a chain 22 associated with driving motor 24 that is intercoupled with the frame 1.

Part of the overall turning device also comprises a sliding, holding and supporting device 28 used for the unloading of the turned over pile 6 towards and onto the pre-feeder 7. This holding and supporting device 28 comprises two parallel arms of which only one arm 29 is visible. Each of these arms 29 is slidingly movable in a guide rail 31, each one of which is attached to a respective one of the side walls of frame 1. The arms 29 are connected together at their front end by means of a spacer 20, and each arm 29 is provided with a toothed rack engaged with a pinion 30 that is intercoupled with a transverse axis driven by a motor (not shown). Pile supports 32 are also interassembled with the spacer 20, connecting one end of arms 29.

A detection mechanism, such as a photoelectric detector or detectors 34 (FIG. 2) is or are located at the input of the turning device, allowing the delivery of a pile 6 to be turned over only when the turning device is ready to receive it. Prior to entering the turn-over grip 12, the piles 6 are aligned on the belt conveyor 5 of the feeding unit with the assistance of a longitudinal wall 33 whose side position can be set according to the width of the cardboard blanks of the piles 6, so as to precisely locate the lateral position of these piles on the conveyor belt 5. This guiding wall 33 also defines the height limits of the piles that are capable of being handled with the turning device of the present invention.

Figure 2:
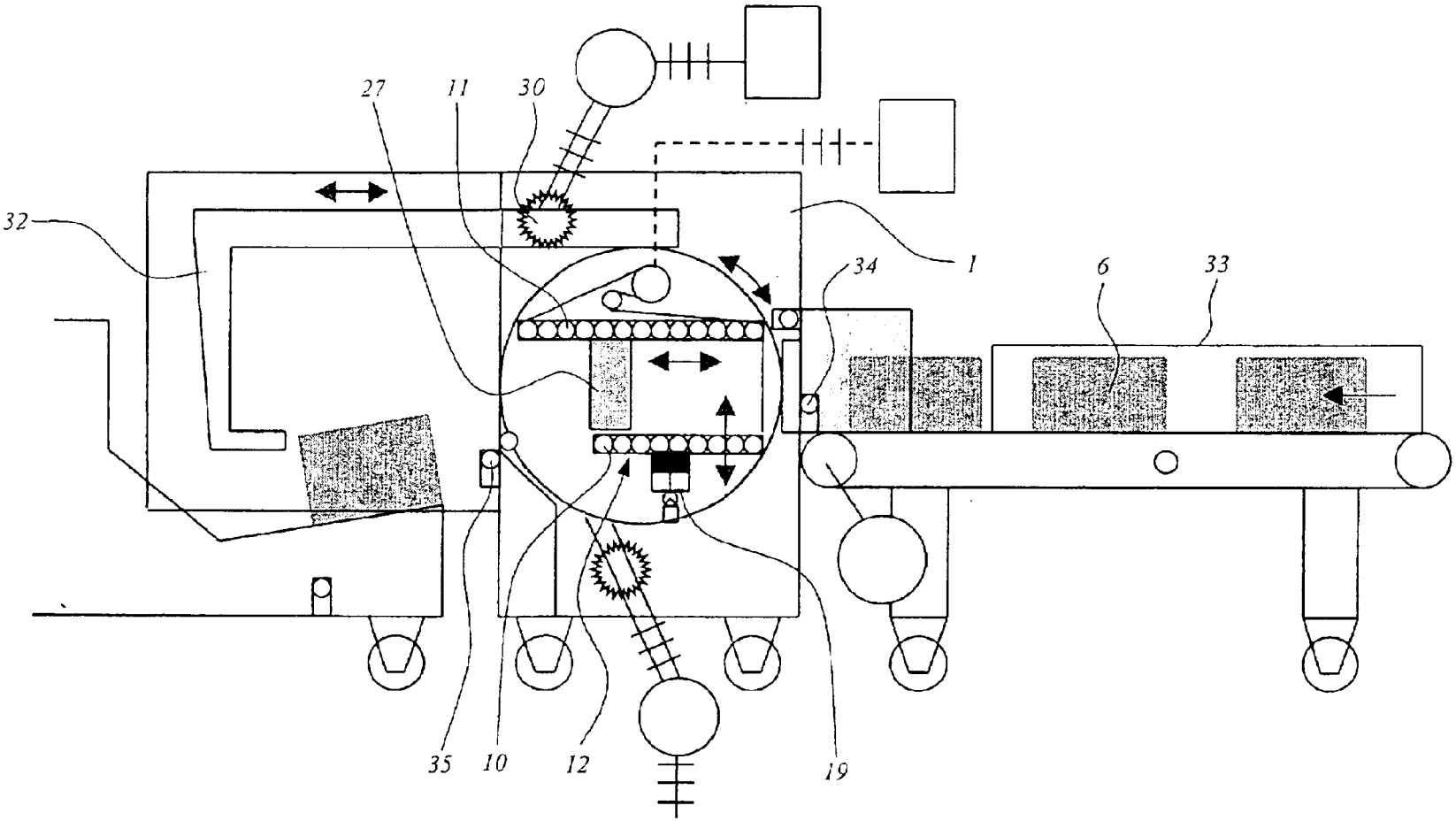
FIGS. 2 through 6 are simplified diagrams of the device illustrated in FIG. 1, describing various stages in the processing cycles of the machine.

The piles 6 that have been aligned on the belt conveyor 5 are then conveyed towards a position located at the input into the turning device, that position being determined by the photoelectric detector 34. The piles await the end of the ongoing turning cycle of the prior pile 6. Thereafter, the current pile 6 is allowed to be introduced into the turn-over grip 12 by the motive force of the belt conveyor 5. When the pile 6 leaves this belt conveyor 5, it rolls gravitationally onto rollers 10 until it comes to stop against the telescopic thrust 27 (FIG. 2).

The position of the telescopic thrust 27 is precisely set according the size of the piles 6 in its conveying direction, with the aid of the driving motor 21 of the belt conveyor 11 to which the pusher carriage 25 is connected.

Figure 3:
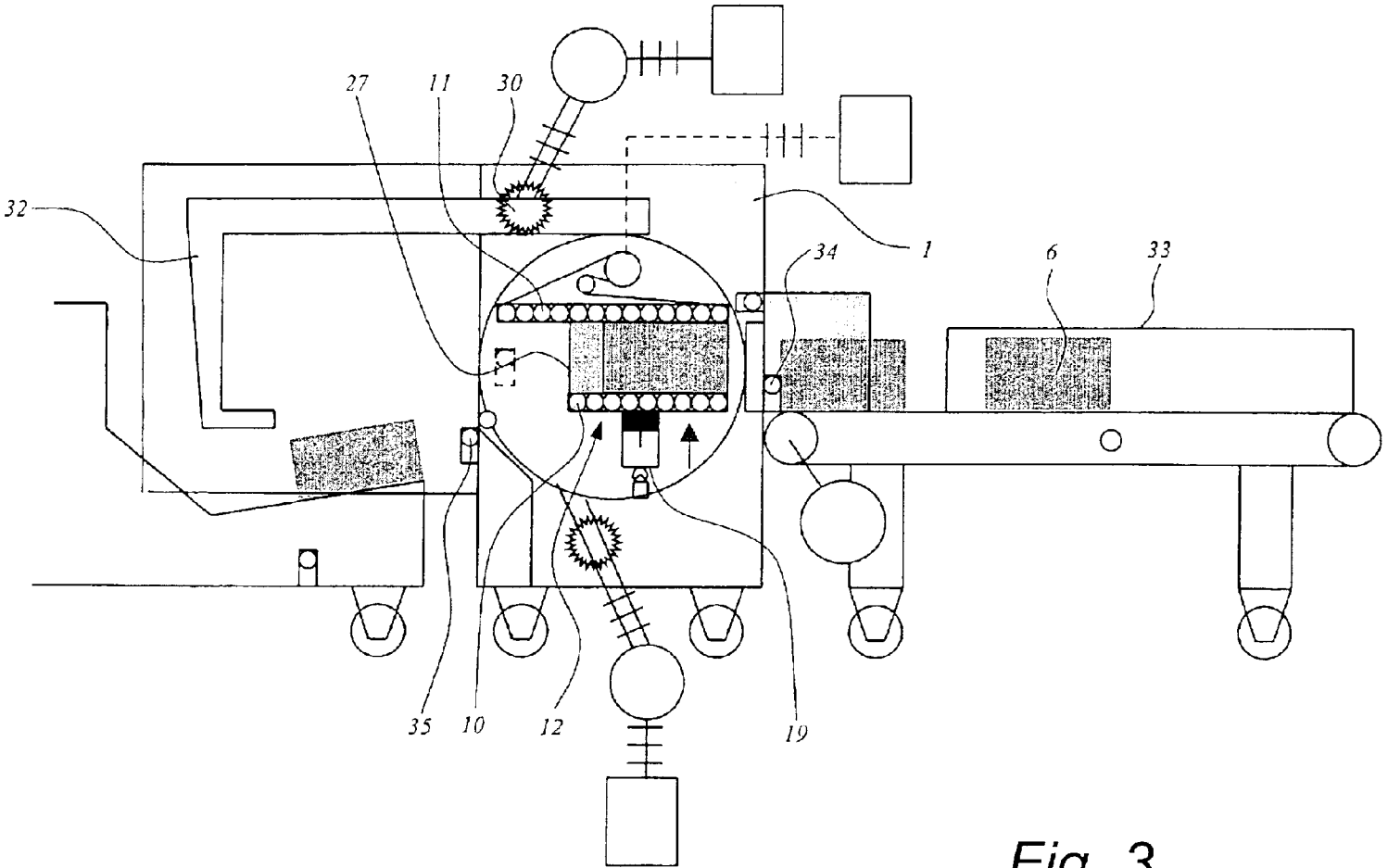

With the pile 6 is in the position shown in FIG. 3, the jack 19 is activated to move the series of rollers 10 towards the belt conveyor 11, thereby tightly sandwiching and pressing on the pile 6 between the conveying units 10 and 11, as illustrated in FIG. 3.

Figure 4:
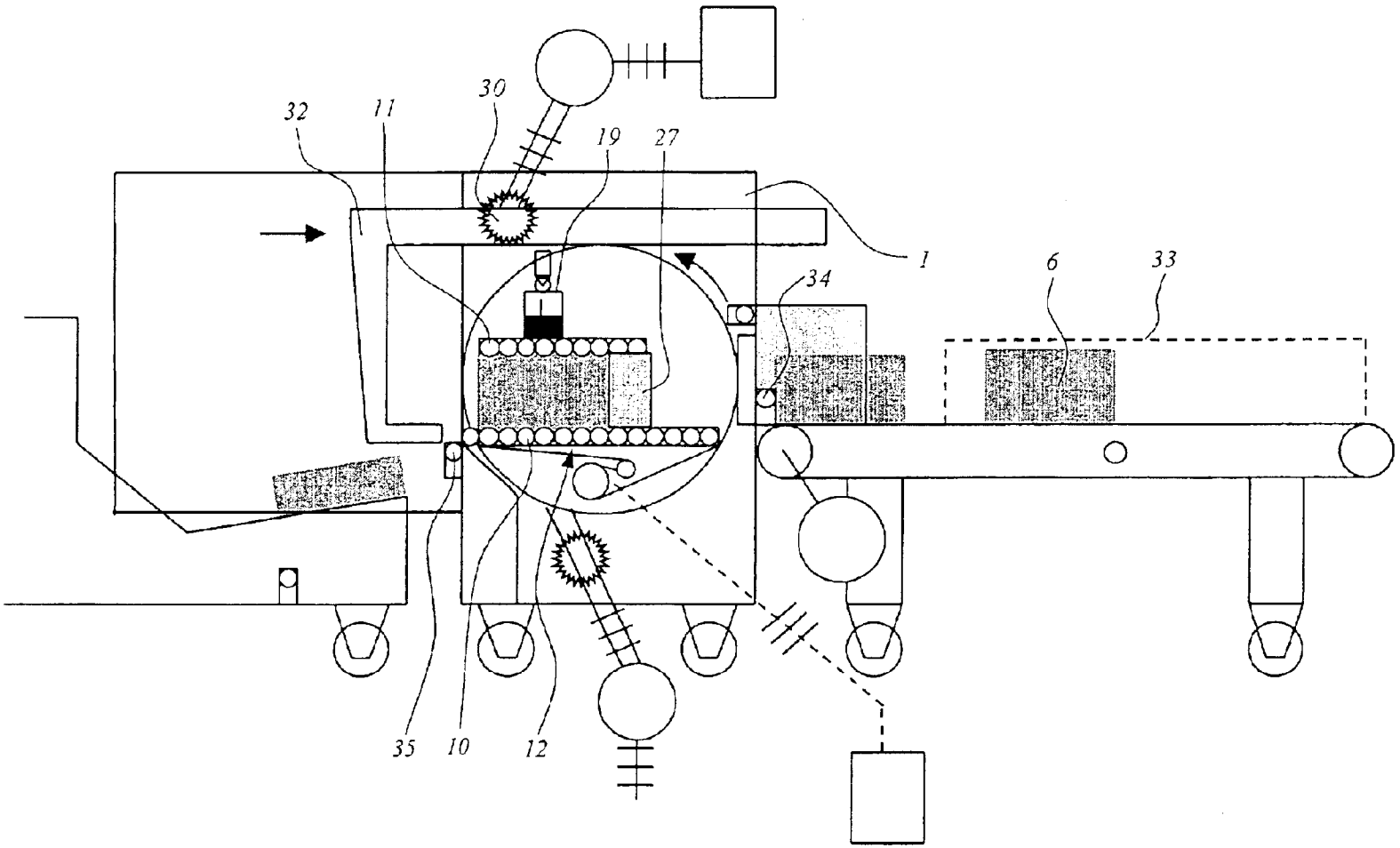
Figure 5:
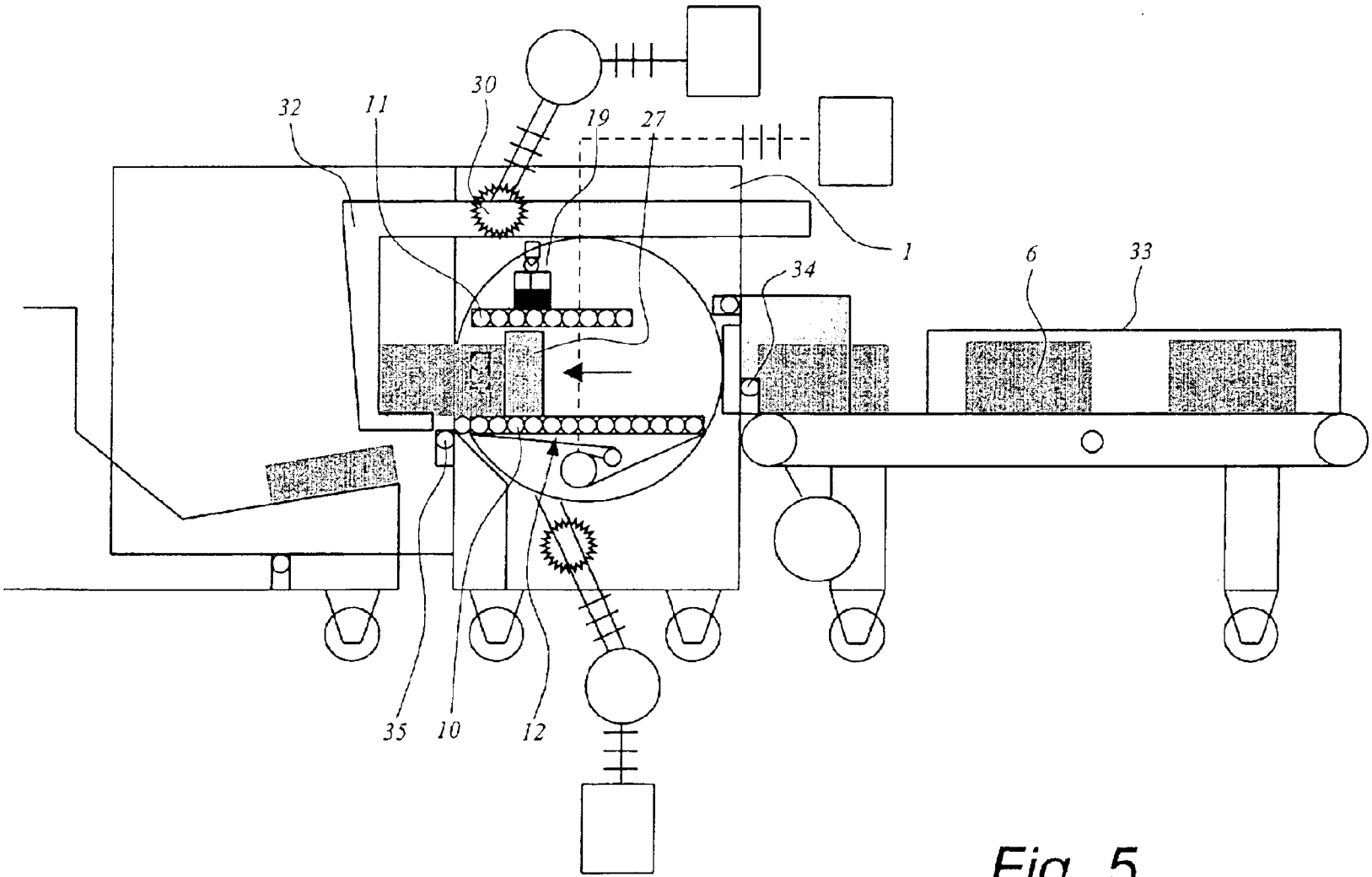

The motor 24 is then operated to cause the turn-over grip 12 to turn 180° in a counterclockwise direction, causing the pile 6 to assume the position illustrated in FIG. 4.

In the next step, the jack 19 is operated to withdraw the series of rollers 10 away from the belt conveyor 11, releasing the tight hold on the pile 6 and on the telescopic thrust 27, allowing the pile 6 to be pushed on the conveying unit 10 forwardly towards the belt conveyor 8 of the pre-feeder 7.

However, the pusher carriage 25, which is intercoupled with the belt conveyor 11, is enabled to carry out an unloading of the pile 6 only if the pre-feeder 7 is able and ready to receive it. To this end, a detection mechanism, such as in the form of photoelectric sensors 35 (FIG. 4), is located at the output of the turning device to detect the presence or non-presence of the previously handled pile 6, whose cardboard blanks are continuously being moved towards a folder-gluer (not shown) located downstream of the pre-feeder 7. As soon as these detectors 35 sense that the prior pile 6 moving on the belt conveyor 8 of pre-feeder 7 has gone below a limit determined by the detectors 35, the piles supporting arm 32 which conveyed the previous pile 6, and which could not previously return to its input position before the level of the pile 6 ensures its traveling, is then allowed to be removed by the pinions 30 in touch with the toothed racks 29, as illustrated in FIG. 4.

The belt conveyor 11 is then enabled to begin moving to remove the pile 6 by conveying it until it reaches the level of the piles supporting arm 32 which, at that moment, moves in synchronism with the belt conveyor 11 until it reaches the height of the gauges 36 of the pre-feeder 7. The piles supporting arm 32 continues to travel until the part of the support under the pile 6 is released, so that the pile 6 moves onto residual blanks remaining on the pre-feeder 7.

Figure 6:
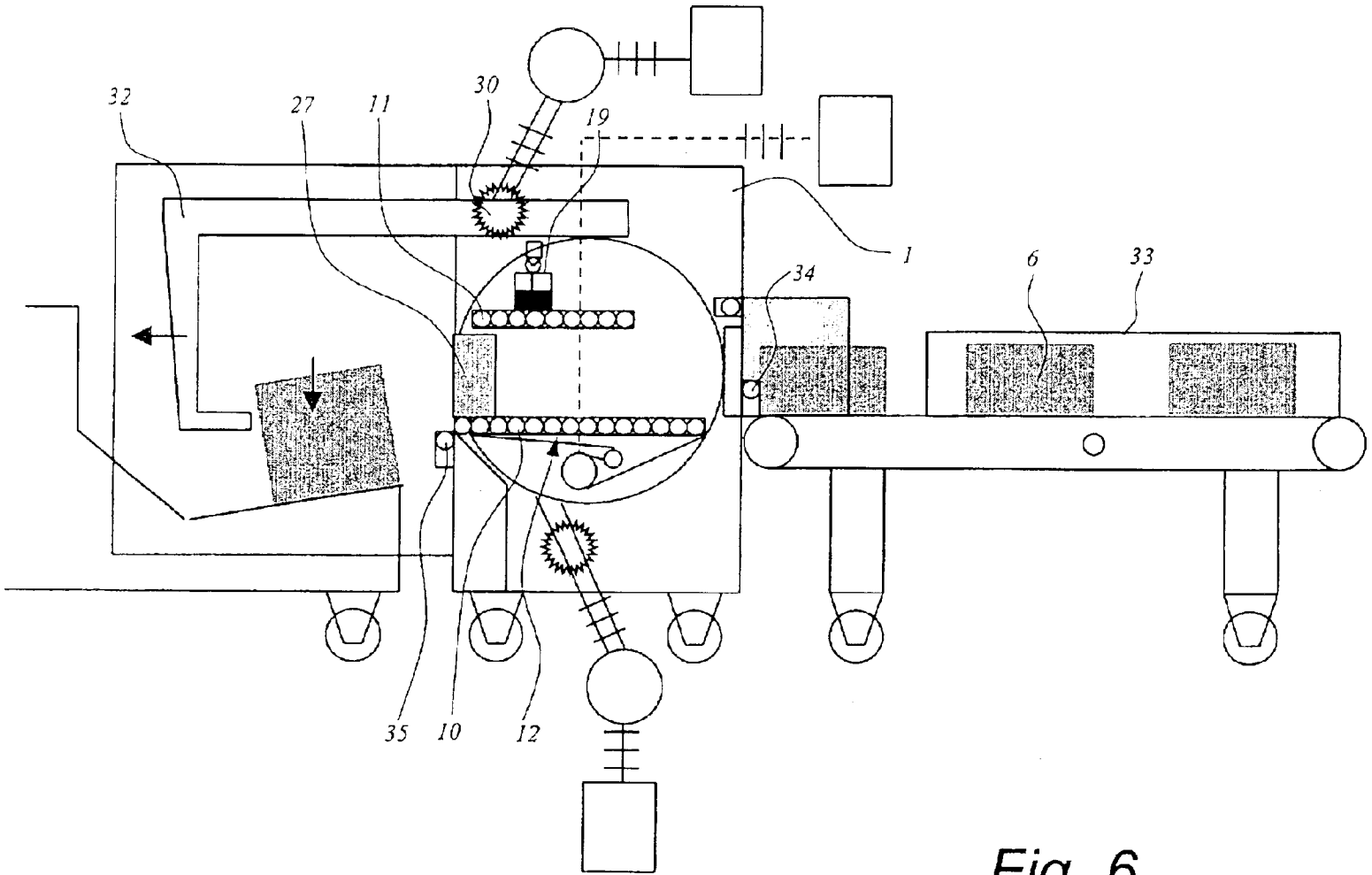

Then, as illustrated in FIG. 6, the piles supporting arm 32 waits until the level of the pile 6 comes down. However, during this process, the pusher carriage 25 returns to its relative position and the turn-over grip 12 turns clockwise 180° to return to its initial position in order to be ready to receive the next pile 6.

In departure from the operation of known turning devices, the printed side of the cardboard blanks forming the pile 6 does not touch any rollers, but rather only the belt conveyor 11, so that the first blank of the pile is marked any more by rollers. Furthermore, the pile 6 is not moved forward, as in the prior art, but is always positively conveyed.

During the unloading of the pile 6 onto the slanted surface 8 of the pre-feeder 7, the pile 6 which previously had straight parallelepiped shape assumes the shape of a parallelepiped, of which one straight section is parallel to the longitudinal run axis of the pile 6 is shaped like a parallelogram. While changing from a straight parallelepiped to the right section shaped like a parallelogram, the angles of the right section of the pile, in the longitudinal conveying direction of the piles, change. This brings about a slipping of the adjacent blanks, facilitating the separation of these blanks from prior blanks.

At the time that the pile 6 are turned over, they abut against the telescopic thrust 27, so that they are supported by this thrust and not maintained only by the pressure of the rollers 10 and the belt conveyor 11. See FIG. 3.

The position of the pusher carriage 25 and its thrust 28 can be precisely controlled by the motor 21, according to the size of the cardboard blanks of In several cases, the box blanks leaving the machine after the processing are in a position that does not need any turning over. In such instances, the present invention permits controlling of the various turning and conveying motors to assure that the piles of blanks travel through the device without being turned over. At the same time, these blanks are still subject to the benefits and advantages of the positive conveying of blanks disclosed in the present description.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for turning over piles of sheet material, comprising:

a frame including an input and an output aligned on a longitudinal conveying direction of the piles;

a turn-over grip mounted to swivel about a horizontal axis extending transversely to the longitudinal conveying path, the turn over grip including two conveying units juxtaposed to one another forming a first conveyor situated for delivering the piles entering the device and a second conveyor which is configured for unloading the piles after a pile has been turned over;

a pressing device that is located to exert a pressure on a pile located between the first and second conveyors during the turning over of a pile; and a pushing mechanism operable and adapted to form a stop for the piles in one position of the turn-over grip and to move to assist the unloading of a turn-over pile off the second conveyor in another position of the turn-over grip.

2. The device of claim 1, in which the first conveyor comprises a series of rollers.

3. The device of claim 1, in which the second conveyor is a belt conveyor.

4. The device of claim 1, in which the pushing mechanism comprises a pusher carriage that is coupled to telescopic thrusts extending between the conveying units and are moveable therebetween.

5. The device of claim 4, in which the pusher carriage is moveable back and forth between the conveying units.

6. The device of claim 1, further comprising a supporting device located at the output of the turn-over grip; a guide for guiding the supporting device along a predetermined path; and a driver to move the supporting device along the guide to move it forward in synchronism with the pusher mechanism.

7. The device of claim 6, further including a detector to detect a pile after its unloading and to control the return back of the supporting unit to an original position.

8. The device of claim 7, wherein the turn-over grip has an unloading end that is intercoupled with a feeding station of a prefeeder and the prefeeder includes a delivery surface having a level lower than that of the second conveyor, the detector for detecting piles after unloading being configured to detect the level of piles after unloading.

9. The device of claim 8, in which the delivery surface is slanted and extends at an angle to a plane passing through the second conveyor.

10. The device of claim 1, including a pile detector located at an input of the frame to detect the presence of a pile at the input.

11. The device of claim 1, including a wheel assembly situated underneath and supporting the frame.

12. The device of claim 11, including a wheel guide, the wheel assembly traveling on the wheel guide.

* * * * *